US005785581A

United States Patent [19]

Settles

[11] Patent Number: 5,785,581

[45] Date of Patent: Jul. 28, 1998

[54] SUPERSONIC ABRASIVE ICEBLASTING APPARATUS

[75] Inventor: Gary S. Settles, Bellefonte, Pa.

[73] Assignee: The Penn State Research Foundation, University Park, Pa.

[21] Appl. No.: 734,444

[22] Filed: Oct. 17, 1996

Related U.S. Application Data

[60] Provisional application No. 60/005,618, Oct. 19, 1995.

[51] Int. Cl.[6] ..... B24C 1/00; B24C 7/00; B24C 9/00

[52] U.S. Cl. ..... 451/99; 451/39; 451/53; 451/60; 451/446

[58] Field of Search ..... 451/36, 38, 39, 451/40, 53, 60, 90, 99, 100, 102, 446; 134/5, 7; 239/14.2

[56] References Cited

U.S. PATENT DOCUMENTS

| | | | |
|---|---|---|---|
| 2,699,403 | 1/1955 | Courts . | |
| 4,038,786 | 8/1977 | Fong . | |
| 4,295,608 | 10/1981 | White | 239/14 |
| 4,389,820 | 6/1983 | Fong et al. | 451/39 X |
| 4,617,064 | 10/1986 | Moore | 134/7 |
| 4,631,250 | 12/1986 | Hayashi | 430/329 |
| 4,655,847 | 4/1987 | Ichinoseki et al. | 134/7 |
| 4,711,395 | 12/1987 | Handfield | 239/14.2 |
| 4,748,817 | 6/1988 | Oura et al. | 62/74 |
| 4,793,554 | 12/1988 | Kraus et al. | 239/2.2 |
| 4,869,090 | 9/1989 | Tada et al. | 451/39 X |
| 4,915,302 | 4/1990 | Kraus et al. | 239/14.2 |
| 4,932,168 | 6/1990 | Tada et al. . | |
| 4,965,968 | 10/1990 | Kelsall . | |
| 4,974,375 | 12/1990 | Tada et al. . | |
| 5,009,240 | 4/1991 | Levi | 134/7 |
| 5,025,597 | 6/1991 | Tada et al. | 451/39 X |
| 5,135,167 | 8/1992 | Ringer | 239/14.2 |
| 5,147,466 | 9/1992 | Ohmori et al. | 134/7 |
| 5,184,427 | 2/1993 | Armstrong . | |
| 5,222,332 | 6/1993 | Mains . | |
| 5,289,973 | 3/1994 | French | 239/14.2 |
| 5,357,718 | 10/1994 | Kanno | 451/39 X |
| 5,367,838 | 11/1994 | Visaisouk | 451/39 |
| 5,379,937 | 1/1995 | Rothe | 239/14.2 |
| 5,390,450 | 2/1995 | Goenka | 451/39 X |
| 5,445,553 | 8/1995 | Cryer et al. | 451/40 X |
| 5,472,369 | 12/1995 | Foster et al. | 451/39 |
| 5,492,497 | 2/1996 | Brooke et al. | 451/99 |
| 5,520,572 | 5/1996 | Opel et al. | 451/99 |
| 5,545,073 | 8/1996 | Kneisel et al. | 451/39 |
| 5,599,223 | 2/1997 | Mains, Jr. | 451/39 |

OTHER PUBLICATIONS

Oguchi, T., "Using Ice To Blast Off Crud," *Nuclear Engineering International*, pp. 49–50, Jan. (1989).

Apple, F. C. and Jahn–Keith, L. S., "Ice blasting flushes as it scrubs," *Nuclear Engineering International*, pp. 44–45, Aug. (1993).

Gillis, Jr., P. J., "Mobile dry–ice units clean up," *Nuclear Engineering International*, p. 45, Aug. (1993).

Anonymous, "Ice blasting is one step in restoring historic site," *Journal of Protective Coatings and Linings*, pp. 52–58, Oct. (1993).

(List continued on next page.)

*Primary Examiner*—Timothy V. Eley
*Attorney, Agent, or Firm*—Thomas J. Monahan

[57] ABSTRACT

The specification discloses an apparatus and method for forming and projecting a continuous flow of frozen particles for the purpose of abrasive cleaning of substrate surfaces. The device utilizes a cryogenic fluid/dry air mixture that interacts with atomized water to form ice crystals. The crystals are projected through a blast nozzle to be directed at a substrate surface. The ice crystals, of a size range below one hundred micrometers, are produced within the apparatus just prior to the nozzle rather than being conveyed to the nozzle by a hose.

8 Claims, 1 Drawing Sheet

OTHER PUBLICATIONS

Settles, G. S., and Garg, S., "A scientific view of the productivity of abrasive blast nozzles," *Journal Protective Coatings and Linings*, , pp. 28–41, 101–102, Apr. (1995).
Lefebvre, A. H, *Atomization and Sprays*, Hemisphere Publishing Corporation, pp. 204–222, (1989).
Wang, X. F. and Lefebvre, A. H., "Mean drop sizes from pressure–swirl nozzles," *AIAA Journal of Propulsion and Power*, 3(1):11–18 (1987).
Seavey, M., "Abrasive blasting above 100 psi," *Journal of Protective Coatings and Linings*, 2(7):26–37, Jul. (1985).
Sampson and Gibson, "A Mathematical Model of Nozzle Blockage by Freezing," *Int. J. Heat Mass Transfer*, 24:231 (1981);.
Baranovskii and Turishchev, "Experimental Study of a Submerged Supersonic Two–Phase Jet," *Inzhenerno–Fizicheskii Zhurnal*, 55:379 (1988);.
Baranovskii et al, "Method of Calculating Supersonic Gas–Droplet Jets," *Inzhenerno–Fizicheskii Zhurnal* ,62:569 (1992);.
Herb and Visaidouk, "Ice Blast Technology for Precision Cleaning," Precision Cleaning '96 Proceedings, p. 172 (1996).
Caimi and Thaxton, "Supersonic Gas–Liquid Cleaning System," Technology 2003, Anaheim, California 1993.
Stacey and Bingham, "Cryogenic Cutting and Cleaning," The Industrial Physicist 232:32 (1996).
Hackett and Settles, "Turbulent Mixing of the HVOF Thermal Spray and Coating Oxidation," Proc. Nat. Thermal Spray Conf. (1994).
Chen and Kevorkian, "Heat and Mass Transfer in Making Artificial Snow," Ind. Eng. Chem. Process Des. Develop. 10:75 (1971);.
Flores et al.,, "Behavious of Swirl Atomizers of Small Dimensions," ICLASS–94, Rouen, France (1994).
Collins and Masterson, "The State of the Art in Snowmaking and its Application to Artic Construction".

SUPERSONIC ABRASIVE ICEBLASTING APPARATUS

This application for patent under 35 U.S.C. § 111(a) claims priority to Provisional Application Ser. No. 60/005,618, filed Oct. 19, 1995, under 35 U.S.C. § 111(b).

FIELD OF THE INVENTION

The present invention relates to a device and method for abrasive cleaning of surfaces by the production of ice crystals that are projected at these surfaces.

BACKGROUND

Abrasive blast cleaning is a century-old process that has seen few changes in the underlying technology since its inception. The traditional approach uses high pressure air to accelerate solid abrasive particles (often sand or steel grit) to high speeds, which then impact the surface being cleaned. This procedure generates large quantities of spent abrasive which is generally contaminated with relatively small amounts of the removed coating (paint flakes, corrosion, radioactive material, etc.). If the material being removed is environmentally-sensitive, the blasting site must be contained and the residue collected and disposed of at a hazardous waste site, all at substantial cost. Also, blasting with inherently-solid abrasives typically creates a dusty environment which can compromise worker health and safety, affect equipment and machinery, and may lead to explosions or other hazards to safety. Yet another drawback of traditional grit blasting in some applications is the damage it causes to the substrate being cleaned. Where the maintenance of dimensional stability is critical, degradation to the finish of a product is a concern, or the substrate is thin/delicate, aggressive blasting is clearly inapplicable. Examples of such applications include aircraft depainting, degreasing precision parts, and the cleaning of delicate silicon wafers used in the microelectronics industry.

The major difference between grit blasting and cryogenic blasting is that, in the latter process, the abrasive material either melts or sublimates upon impact, or shortly thereafter, thereby greatly simplifying the cleanup and disposal process. There is virtually no dust generation or airborne contamination, and in the case of ice blasting the material removed is washed away with the melted ice, thus providing a flushing or rinsing action absent in grit blasting. In addition, due to the comparatively low hardness of ice (approximately 4 on Mohs scale, depending on ice-making temperature, per Ohmori, et al., U.S. Pat. No. 5,147,466, September 1992) or carbon-dioxide pellets, these methods are relatively benign to a hard substrate and do not impart a damage profile to it.

In response to some of the concerns mentioned above, techniques have been developed that employ either ice or dry ice as the abrasive (Oguchi, T, "Using Ice To Blast Off Crud," *Nuclear Engineering International*, January 1989, pp. 49–50 and Weiner, M., "People in finishing: carbon dioxide blasters," *Metal Finishing*, September 1993, pp. 9–10). These techniques (dubbed "ice-blasting" or "cryogenic blasting") have been used in the decontamination of irradiated material (see Oguchi, T, "Using ice to blast off crud," *Nuclear Engineering International*, January 1989, pp. 49–50; Apple, F. C. and Jahn-Keith, L. S., "Ice blasting flushes as it scrubs," *Nuclear Engineering International*, August 1993, pp. 44–45; and Gillis, Jr., P. J., "Mobile dry-ice units clean up," *Nuclear Engineering International*, August 1993, p. 45) and also for the removal of loose rust and lead-based paint (see Anonymous, "Ice blasting is one step in restoring historic site," *Journal of Protective Coatings and Linings*, October 1993, pp. 52–58). The basic technology underlying these processes is the subject of several patents, hereby incorporated by reference, (see Armstrong, J., U.S. Pat. No. 5,184,427, February 1993; Ohmori, T., et al., T., U.S. Pat. No. 5,147,466, September 1992; Levi, M. W., U.S. Pat. No. 5,009,240, April 1991; Tada, M., et al., U.S. Pat. No. 4,974,375, December 1990; Tada M., et al., U.S. Pat. No. 4,932,168, June 1990; Oura, H., et al., U.S. Pat. No. 4,748,817, June 1988; Ichinoseki, T., et al., U.S. Pat. No. 4,655,847, April 1987; Hayashi, C., U.S. Pat. No. 4,631,250, December 1986; Moore, D. E., U.S. Pat. No. 4,617,064, October 1986; Fong, C. C., U.S. Pat. No. 4,038,786, August 1977; and Courts, E. J., U.S. Pat. No. 2,699,403, January 1955) and is sufficiently developed that commercial cryogenic blasting devices are now available (Weiner, M., "People in finishing: carbon dioxide blasters," *Metal Finishing*, September 1993, pp. 9–10; and Gillis, Jr., P. J., "Mobile dry-ice units clean up," *Nuclear Engineering International*, August 1993, p. 45). Furthermore, U.S. Pat. No. 4,965,968 to Kelsall describes the use of solid carbon dioxide or solid argon particles, while U.S. Pat. No. 5,367,838 to Visaisouk et al. teaches the warming of ice to its melting point before projection at the surface to be cleaned. U.S. Pat. No. 5,492,497 to Brooke et al. also teaches a sublimating particle blasting device, and U.S. Pat. No. 5,520,572 to Opel et al. describes a system for shaping and delivering uniformly sized, solid carbon dioxide pellets to an accelerator. However, all of these inventions suffer from the disadvantage of requiring the prefabrication of the blast medium (pellets) that is stored in a reservoir, limiting the use of the device to the ability to create an adequate supply of blast media, as well as making it cumbersome and expensive. U.S. Pat. No. 5,472,369 to Foster et al. teaches the use of cryogenic fluid with a vibrating nozzle to create blast media, but it is nevertheless placed in a hopper for storage before blasting. On the other hand, U.S. Pat. No. 5,222,332 to Mains teaches the creation of a needle-like stream of water by mixing water with cryogenic fluid at the blast nozzle, but this method does not offer a reliable continuous supply of abrasive material, as the water portion is of little abrasive value and the nozzle is prone to ice-clogging due to the mixing of the cryogenic fluid with water at the blast nozzle itself.

Thus, many of the current techniques first manufacture relatively large particles or pellets of ice or dry ice, then transport them through a hose to the blast site where they are accelerated through the blast nozzle. This necessitates the incorporation of complex ice-making and handling systems, which add to the cost of the equipment. As a result, ice blasting equipment is generally more expensive than conventional grit blasting equipment. Also, due to the comparatively low hardness of the abrasive used, ice blasting is less aggressive and can take longer to perform a given job than grit blasting. Another concern is that the relatively large size of the ice pellets used tends to dent thin substrates such as aircraft panels and even spall or damage the paint coating on the back side of the surface being cleaned.

Additionally, there are devices that are capable of creating frozen particles as snow-making equipment. (See U.S. Pat. No. 4,711,395 to Handfield, U.S. Pat. No. 4,793,554 to Kraus, et al., U.S. Pat. No. 4,295,608 to White, U.S. Pat. No. 4,915,302 to Kraus, et al., U.S. Pat. No. 5,135,167 to Ringer, and U.S. Pat. No. 5,289,973 to French.) However, as they produce artificial snow after the blast nozzle and are dependent upon the ambient temperature of the atmosphere, these devices are incapable of producing snow at temperatures low enough and velocity high enough to permit the accelerated particles to have an abrasive effect.

Therefore, there is a need for a compact apparatus for efficient abrasive cleaning of substrate surfaces whereby such surfaces are not damaged.

SUMMARY OF THE INVENTION

The present invention is an abrasive ice-blasting apparatus and process that is different from previous approaches. The main difference between the present and previous approaches lies in the manufacture of the ice particles near the point of use just before the blast nozzle, as opposed to remote manufacture and subsequent transport to the blasting equipment. The present method thus eliminates the complex and expensive ice-making and handling systems required by earlier techniques. The ice is manufactured by producing fine water droplets via atomization and freezing them by exposing them to a cold gas. These particles are then immediately accelerated through the blast nozzle.

In one embodiment, the device comprises a mixing chamber with a cryogenic fluid inlet and an air inlet connected to one end of the mixing chamber. The other end of the mixing chamber is attached to a ninety-degree T-coupling with a water atomizer on one end of the T coupling and a freezing chamber on the other end of the T-coupling. A blast nozzle is connected on the downstream end of the freezing chamber. In one embodiment, the blast nozzle is a supersonic and/or converging-diverging blast nozzle. In one embodiment, the mixing chamber contains a flow spreader. In a preferred embodiment, the water atomizer is a pressure-swirl atomizer. There can be a transition coupling between the freezing chamber and blast nozzle.

It is not intended that the present invention be limited by the precise dimensions; nonetheless, in one embodiment the diameter of the transition coupling can be approximately fifty millimeters while the throat diameter of the blast nozzle can be approximately one to ten millimeters. The mixing chamber can be approximately fifty centimeters long with a diameter of five centimeters. In preferred embodiments, the diameter of the coupling and freezing chamber is eight to ten times the diameter of the blast nozzle throat diameter.

In one embodiment, the length of the blast nozzle is approximately one hundred to one hundred fifty millimeters and the exit to throat area ratio is approximately 1.5 for 85 pounds per square inch absolute (p.s.i.a.) operation with an exit Mach number of 2.3, but this ratio can be higher for higher-pressure operation.

The present invention contemplates a method for propelling particles by providing i) atomized water having a droplet size and droplet size distribution, ii) a cooling means for freezing said atomized water, and iii) a blast nozzle, then freezing the atomized water with the cooling means to form frozen particles, and accelerating the particles through the blast nozzle. In one embodiment, the cooling means comprises cold gas formed by mixing cryogenic fluid with dry air.

It is not intended that the present invention by limited by the nature of the cryogenic fluid. In one embodiment, the cold gas contains at least approximately forty percent nitrogen. Alternatively, the cold gas can comprise no more than approximately fifty percent nitrogen.

It is also not intended that the invention be limited by the precise temperatures used. The temperature of the cold gas is preferably below approximately 180 Kelvin, while it is not unusual to operate the method at 150 Kelvin. Temperatures below 100 Kelvin will not generally be required.

Finally, it is not intended that the present invention be limited by the precise size of the particles. The typical diameter of the particles can be approximately seventy micrometers in diameter and can be propelled at least two hundred thirty meters per second. However, in one embodiment, the droplets dispensed by the atomizer are approximately ten micrometers in average diameter. It is expected that the particles will cover a range of sizes rather than a single particle diameter.

DEFINITIONS

The following definitions are provided for the terms used herein:

"Mixing chamber" means a cavity or enclosure with selective openings to allow the entrance and/or exit of fluids, and their mixture by turbulence within.

"Cryogenic fluid" means a liquid or gas, the temperature of which is well below the freezing point of water (a preferred cryogenic fluid is liquid nitrogen);

"air source" means a supply of standard air or dry air (e.g., a pressure tank with a regulator)

"cold gas" is a mixture of air from an air source and cryogenic fluid;

"air inlet" refers to a selective opening to the mixing chamber that permits the entrance of gas (such as dry air);

"water atomizer" means a device that converts creates a dispersion or spray of water droplets in the form of "atomized water";

"pressure-swirl atomizer" refers to a water atomizer that emits the water droplets in an eddying or whirling fashion due to its design and upstream pressure applied to it;

"cooling means" is a means (e.g., cold gas) for cooling a subject (e.g., atomized water);

"freezing chamber" means a cavity or enclosure with selective openings to permit the entrance of atomized water and/or gas and an outlet to permit the exit of mixed fluids and solid particles;

"in fluidic communication" refers to the connection of two bodies such that gas, liquid or solid particles may pass between them; for example, liquid connections may comprise channels, tubes, or other conduits that allow for a stream to move from one element of the device to another, thereby permitting "fluidic communication" between such elements;

"blast nozzle" refers to a duct so shaped that it accelerates the flow of gas containing liquid or solid particles;

"supersonic blast nozzle" refers to a blast nozzle whose design permits the acceleration of gas containing liquid or solid particles such that it exits the nozzle at speeds in excess of the speed of sound, one form of a supersonic blast nozzle is a "converging-diverging nozzle," which refers to the generic shape of the supersonic blast nozzle defined above;

"throat diameter" refers to the smallest diameter of the channel in a blast nozzle duct;

"nozzle exit diameter" refers to the diameter of the exit opening of a blast nozzle;

"exit to throat area ratio" refers to the ratio of the throat area to the exit area;

"flow spreader" refers to a device that distributes the flow of gasses and/or liquids such that it encourages the mixing of such gasses and/or liquids over the width of the enclosing duct;

"substrate surface" refers to a solid material to be cleaned; for example, painted metal, surfaces covered with grease or varnish, etc.;

"transition coupling" is a duct segment smoothly joining two ducts of different diameter and/or cross-sectional shape;

"T-coupling" refers to a hollow device with three openings (that can be in a ninety degree configuration) that permit the entrance and/or exit of gasses, liquids and solid particles;

"artificial nucleator" refers to a chemical additive (e.g., SNOMAX) that raises the freezing temperature of liquid (e.g., water).

DESCRIPTION OF THE FIGURES

The FIGURE 1 is a schematic of the general layout of one embodiment of the device of the present invention.

DESCRIPTION OF THE INVENTION

Figure 1:
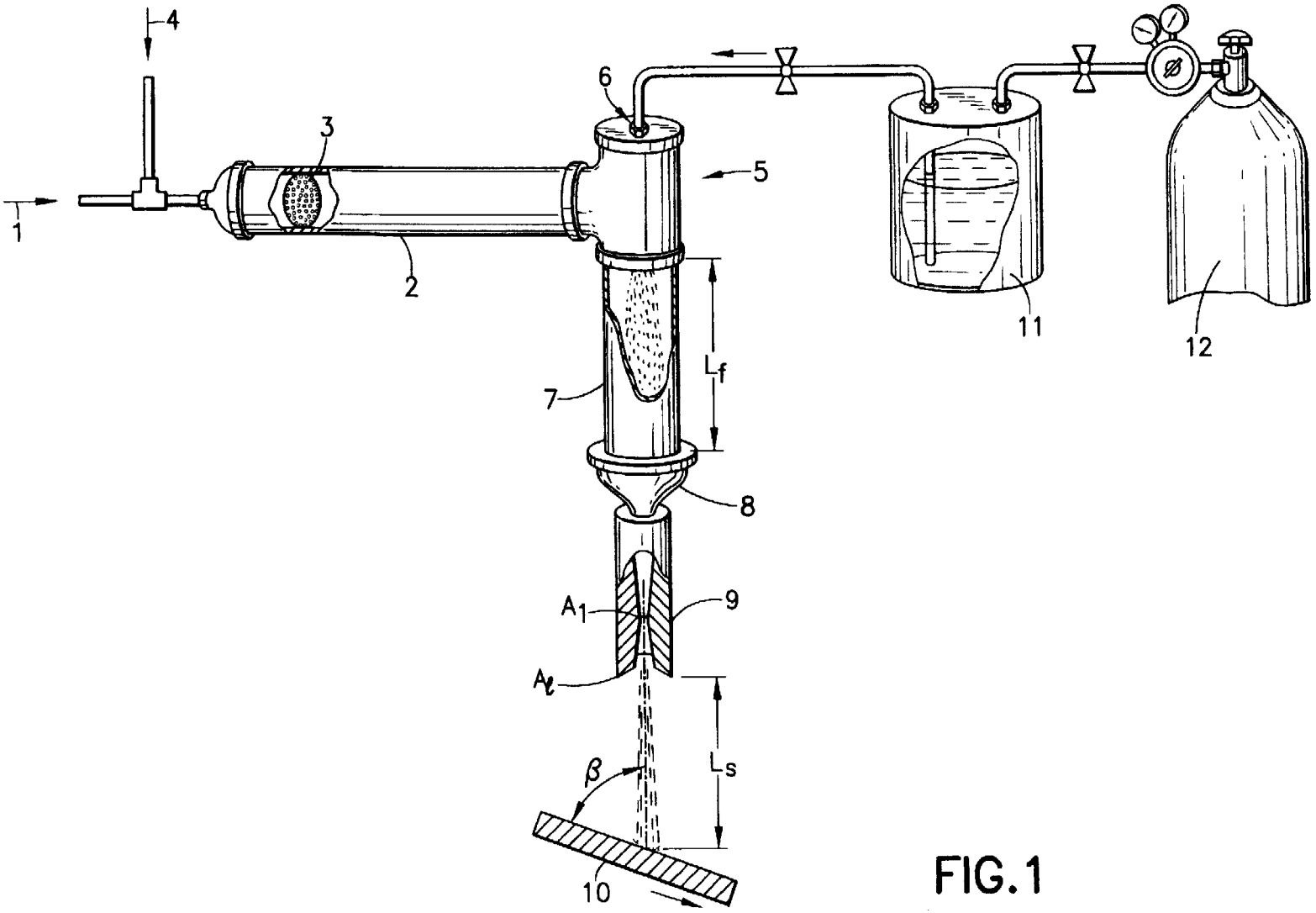

The present invention is a device and method for the abrasive cleaning of substrate surfaces with ice. The device is capable of producing ice crystals on demand and therefore can be used continuously as needed.

Generally, a cryogenic fluid and dry air are mixed in accordance with the method of the present invention in a mixing chamber to form cold gas. The percentage components of the mixture can be varied to suit the needs of the user. A larger percentage of cryogenic fluid will result in colder gas and harder particles, while a smaller percentage can allow for relatively warmer gas and softer particles, which will also reduced the overall cost of operation. The cold gas is then introduced into a freezing chamber.

Water is also introduced into the freezing chamber in the form of droplets by passing the water through a water atomizer. The size of the water droplets can be varied to suit the users purposes; however, as the purpose of the present invention is to accelerate these water droplets, when frozen, after freezing, the inertia of 1000 μm droplets can be too great for significant acceleration to occur (so these droplets exhibit little increase in their velocity, even far downstream of the nozzle). On the other hand, smaller (e.g., approximately 10 and less than 100 μm) droplets follow the fluid velocity closely and achieve a significant fraction of the fluid velocity at the exit of the nozzle. Likewise, the performance of 100 μm droplets is more modest; these droplets attain only about half the fluid velocity at the nozzle exit.

In the freezing chamber, the cold gas freezes the water droplets. Though not necessary, this process can be assisted by the inclusion of an artificial nucleator, such as SNOMAX Snow Inducer (Polaroid Corporation, Cambridge, Mass.). SNOMAX is a protein derived from *Pseudomonas syringae* and has been shown to raise the static freezing temperature of water by as much as 9° C.

These frozen particles (which have, as described above, been formed prior to reaching the nozzle) are then accelerated through a blast nozzle. The blast nozzle itself is similar to typical sand-blast nozzles. For example, a simple nozzle with conical converging and diverging sections is useful. The ice crystals can then be directed at a substrate surface to be cleaned.

DESCRIPTION OF THE PREFERRED EMBODIMENTS

FIG. 1 shows a schematic of one embodiment of the supersonic iceblasting system of the present invention. An 85 p.s.i.a. pressure reservoir 1 is charged with dry air and provides an essentially unlimited supply of compressed air for the blasting rig. A smaller supply tank can be used with equivalent results. The air is conveyed to a 5 cm (2 inch) inside diameter mixing chamber 2, containing a flow spreader 3, that is approximately 50 cm long and is instrumented to allow monitoring of the total pressure and temperature. The flow spreader is a perforated plate perpendicular to the axis of the mixing diameter and containing multiple perforations, typically one to two millimeters in diameter. Immediately prior to this mixing chamber the airstream is mixed with a small quantity of liquid nitrogen through a T-coupling 4. The liquid nitrogen flashes to vapor upon coming into contact with the air and serves to reduce the total temperature of the mixture.

The flow at the downstream end of the mixing chamber is turned through a 90 degree T-coupling 5 such that the blasting jet exits vertically downward. As shown in FIG. 1, an atomizer 6 (Delevan Corp. Model WDB 0.5-3.0, Bamberg, S.C.) is installed at the top of the T-coupling. This produces the fine water droplets that are frozen to form ice crystals, which are then used as the abrasive material. The spray produced by the atomizer 6 interacts with the cold air-nitrogen mixture in the freezing chamber 7 and the resulting ice crystals are propelled through a transition coupling 8 into the blast nozzle 9. The two-phase flow is accelerated to high speeds in the blast nozzle 9, (machined to purpose) and the particle-laden jet impinges upon the work piece 10 a certain distance downstream of the nozzle exit.

Water is supplied to the atomizer from a water reservoir 11 that can be pressurized to a range of pressures above the stagnation pressure of the gas flow by a pressurizing means 12, typically a compressed-air source such as a gas cylinder with regulator. A positive overall pressure differential is necessary for operation of the atomizer. Also, somewhat more importantly, the characteristics of the droplets produced by the atomizer (droplet size and velocity) are a strong function of this pressure differential and of the atomizer design.

The parameters found to have the most influence upon the performance of the supersonic iceblasting system, are the mass flow rates of air, liquid nitrogen, and water. Other important parameters include the cold gas stagnation temperature and pressure, the length of the freezing chamber ($L_f$) the standoff distance ($L_s$) the blasting angle ($\beta$,) and the atomization pressure. The blast nozzle is characterized by its throat area ($A_t$) and exit area ($A_e$).

Various blast nozzles designs may be used, (Boride Corp., Traverse City, Mich.) so only a general description is given here. The nozzles have dimensions similar to those used in conventional sand blasting equipment and were designed to be operated at comparable stagnation pressures. Further, the exit-to-throat area ratio was such that a perfectly-expanded jet was produced at the desired stagnation pressure. For such a jet operating at approximately 700 kPa (100 psi) stagnation pressure and exiting into ambient atmosphere, the nozzle exit-to-throat area ratio is about 1.5 and the resulting jet has a Mach number of approximately 1.8. In terms of actual dimensions, the nozzle throat diameter was typically approximately 7–8 mm and the nozzles were about 100–150 mm long. For further discussion of blast nozzles see Settles, G. S., and Garg, S., "A scientific view of the productivity of abrasive blast nozzles," *Journal of Protective Coatings and Linings*, April 1995, pp. 28–41, 101–102.

EXAMPLE I

Preliminary Computations and Experiments

Some preliminary water atomization experiments were conducted with ambient-stagnation-temperature air in which the jet issuing from the blast nozzle was visualized. It was observed that there were no ice crystals in the jet and, further, all the water injected into the gas stream exited on the periphery of the jet along the nozzle walls; there were virtually no water droplets in the core of the jet. Though not an understanding of the mechanism of the invention is not needed to practice the present invention, a physical explanation for this phenomenon is as follows: First, there is a spreading angle associated with the spray produced by any atomizer, which implies that the water droplets initially possess some radial velocity. Also, when the flow passes through the converging portion of the nozzle, the gas flow streamlines converge towards the centerline of the nozzle. The water particles, having much more inertia than air particles, cross the streamlines and strike the nozzle walls. These water droplets do not bounce back after impacting the wall, but rather wet the wall and flow along it. The result is that the majority of the water trickles along the warm (in comparison to the air stream) wall and never has a chance to freeze.

This implies that it is essential for the water droplets to be frozen upstream of the blast nozzle entrance. This further ruled out the possibility of utilizing only the adiabatic expansion and cooling of the air in the blast nozzle to freeze the water droplets. The only other alternative was to precool the gas stream via an external heat exchanger or by mixing it with liquid nitrogen as mentioned above. The second alternative was chosen and modified to the existing setup was the addition of a transition coupling through which liquid nitrogen could be mixed with the incoming air (FIG. 1). The liquid nitrogen was supplied from a reservoir at approximately 1400 kPa (200 psi) pressure, and its flow rate could be easily regulated by a valve (not shown). All subsequent tests were conducted with cold gas conditions, i.e. with varying amounts of liquid nitrogen mixed with the air. The determination of the amount of liquid nitrogen to be used is the subject of a separate section below.

The preliminary experiments described above serve the important purpose of illustrating the deficiencies of the original proposal and providing the basis for a practical alternative. Once the basic configuration had been decided upon, it remained to assemble and/or design the various components of the system which would achieve the desired objective in the most efficient manner possible. This is described below.

EXAMPLE II

The Atomizer

An appropriate atomizer is one of the most critical components of the current ice-blasting system. It was shown above from considerations of droplet freezing and acceleration that the optimum droplet size is approximately 100 μm or less. Two other important parameters that are directly controlled by the choice of atomizer are the spreading rate of the spray and initial droplet velocity.

As a first attempt, a simple hypodermic tube was chosen to be the water delivery/atomization device. This is among the simplest types of atomizer possible and depends upon the breakup of the liquid jet issuing from its exit to produce fine drops. It was evident from early experiments with the hypodermic tube that a high exit velocity (and high injection pressure) was required to produce atomization within a reasonable distance of the tube exit. This is because the long slender tube tends to damp out disturbances and delay breakup of the liquid jet into droplets. Jet velocities at which breakup occurred within a short distance of the exit were estimated to be around 100 m/s. The resulting residence time of the droplets in the freezing chamber (approximately 0.5 m long) was too short to allow sufficient heat transfer to take place between droplets and air stream. As a result, unfrozen drops impacted the bell-shaped transition section (see FIG. 1), froze on the cold wall, and initiated ice buildup, eventually clogging the apparatus. Blockage due to ice buildup occurred very rapidly, typically taking only 30 seconds from the start of water injection. External heat application to the transition joint helped somewhat, but did not prevent this phenomenon from occurring. Usually, the buildup of ice just moved downstream into the converging portion of the blast nozzle. Further, from visual observation of the spray produced by this atomizer, the typical droplet diameter was estimated to be of the order of 1 mm, too large for the present purpose.

A different atomizer design was required; one that would produce finer droplets with lower velocities. The next choice was an orifice-type atomizer, which is essentially a very short tube with small length-to-diameter ratio, L/D. It was manufactured in-house by micro-reaming a 0.6 mm diameter hole in 2 mm thick copper sheet, which was silver-soldered to the end of the delivery tube. Due to the small L/D of this type of atomizer, disturbances created at the sharp-edged orifice entrance are not damped out, and full atomization can be achieved at the jet exit with lower exit velocities compared to those of a larger L/D device.

The orifice-type atomizer is widely used (in diesel fuel injectors, for example) and has been extensively studied. It is known that the droplet size it produces varies inversely with injection pressure, thus a certain degree of control can be exercised by varying this pressure. However, the exit velocity of the jet increases as the square-root of the injection pressure, and thus smaller drops generally have higher velocities. This proved to be a significant limitation as the droplets produced by this type of atomizer also had high velocities (around 50 m/s) and small residence times in the freezing chamber. The result was the same as with the hypodermic tube, ice buildup on the transition coupling and eventual blockage of the equipment.

Finally, after an examination of the various types of atomizers available, a commercial pressure-swirl atomizer (Delevan Corp., Bamberg, S.C.) design was chosen for testing. The predominant consideration was low droplet velocity (of the order of 1 m/s) to provide sufficient time for freezing upstream of the transition coupling. Pressure-swirl atomizers impart swirl to the liquid inside the nozzle with the result that the liquid exits as a thin, conical, swirling sheet that breaks up into droplets due to the combined action of liquid instability and aerodynamic forces due to interaction with air stream (see Lefebvre, A. H, *Atomization and Sprays*, Hemisphere Publishing Corporation, 1989). In this type of device, a large portion of the pressure head is converted into radial and circumferential momentum, resulting in much lower axial velocities than for orifice-type atomizers operating at the same injection pressure. This generally results in larger spreading rates for swirl atomizers as well, which is an undesirable effect for the present application. However, this factor was apparently not very important since the much-lower droplet velocities ensured that a majority of the drops froze before striking the chamber walls, whence they returned to the main flow.

The main factors governing the atomization quality of pressure-swirl atomizers are the liquid properties (surface tension, viscosity), liquid flow rate, gas properties (pressure and temperature, usually combined in the form of density), injection pressure, and nozzle geometry. Due to the complexity of the physical phenomena involved, the study of atomization by these nozzles has generally been accomplished by empirical means. There are many empirical expressions available in the literature for predicting the drop size and distribution produced by pressure-swirl atomizers (see Lefebvre, A. H. *Atomization and Sprays*, Hemisphere Publishing Corporation, 1989, pp. 204–222). For operating conditions and nozzles similar to the present, Wang and Lefebvre (see Wang, X. F. and Lefebvre, A. H., "Mean drop sizes from pressure-swirl nozzles," *AIAA Journal of Propulsion and Power*, Vol. 3, No. 1, 1987, pp. 11–18) have measured mean drop sizes in the range 30–100 m, the smaller drop sizes corresponding to higher injection pressures.

The atomizing nozzle chosen was a Delavan WDB 0.5-30 (Delevan Corp., Bamberg, S.C.) with a nominal flow rate of 0.5 gallons/hour at an injection pressure of 860 kPa (125 psi), and a manufacturer-specified spreading rate of 30 degrees. This nozzle was tested at injection pressures ranging from 210–2100 kPa (30–300 psi). Qualitatively, when operated in still air, the atomizer produced a fine mist that drifted gently to the ground. It was found that the spreading rate was about 45 degrees for the entire range of pressures tested, and the water flow rate exhibited the expected square-root variation with injection pressure. For the ice-blasting tests the operating pressure was chosen to be about 1500 kPa (220 psi). This value was chosen as a compromise between the droplet size, which decreases with injection pressure, and the flow rate, which increases with injection pressure. The water flow rate at this pressure was approximately 0.5 ml/s, and the mean droplet size was estimated to be about 30 μm.

Thus, the properties of the droplets produced were close to the ones desired and the pressure-swirl atomizer was thence used for all subsequent tests. Most importantly, it produced ice crystals in the blasting jet that had the sought-for abrasive effect on a painted metal sample.

EXAMPLE III

Transition Coupling and Converging-Diverging Nozzle

It has been mentioned above that ice buildup in the transition coupling and/or the converging portion of the blast nozzle was a frequent problem encountered during early testing. As a possible solution, it was decided to eliminate sharp edges and steep curves, where ice tended to collect, from both locations. The two components were combined into a long, gradual conical contraction from the 50 mm diameter freezing chamber to the 8.1 mm diameter throat of the nozzle.

The diverging portion of the nozzle was fabricated as a separate piece that could be screwed onto the end of the converging portion. Some pertinent dimensions in addition to the ones already mentioned are a nozzle exit diameter of approximately 9.7 mm and an overall length of approximately 156 mm. The throat to exit area ratio is approximately 1.44, and the exit Mach number is approximately 1.8. Also, for these conditions, the stagnation pressure required for a perfectly-expanded jet exiting to atmosphere is approximately 580 kPa (85 psi).

EXAMPLE IV

Optimization of Device Performance/Operating Conditions

Some effort was next invested into improving the device's abrasive efficiency and cost-effectiveness. The two most important goals were minimization of liquid nitrogen consumption (to reduce expense) and maximization of ice/air mass flow rate (for maximum abrasive effect). These efforts are now described.

The first goal can be achieved by using the minimum quantity of liquid nitrogen necessary to freeze all the water droplets in the spray. A theoretical determination of this quantity is possible for the ideal case of a single water droplet in the blasting apparatus. However, in reality, the atomizer produces a spray of water droplets that modifies the gas flow around it. A calculation based on a single droplet would be a gross oversimplification and almost certainly far from reality.

It was therefore decided to achieve this objective empirically. The procedure employed was as follows: The ratio of liquid nitrogen to air mass flow rates was varied while keeping all other operating parameters constant. First, air-only flow was established and the pressure in the stilling chamber was brought up to some value less than the desired total pressure. This pressure and the temperature in the stilling chamber were recorded. From this information, and the nozzle throat area, the mass flow rate of the air was later calculated. Next, enough liquid nitrogen flow was added to bring the stagnation pressure up to its full value and the new pressure and temperature were recorded. The flow rate of air remained the same as before, since the valve between the main air-storage tank and the experimental rig was choked and had not been varied. Therefore, the air-only mass flow rate could be subtracted from the total mass flow rate to obtain the mass flow rate of the nitrogen. This procedure was repeated with differing proportions of air and nitrogen contributing to the desired operating pressure. Nitrogen-to-air flow rates in the ratio of approximately 40:60 percent are required for stagnation temperatures below 200 Kelvin, and an approximately 50:50 ratio decreases the total temperature to approximately 150 Kelvin.

Further, the blasting jet was visualized and some actual abrasion tests were also carried out during these experiments. The visualization clearly revealed when there were unfrozen water droplets exiting the nozzle. In which case, there are no scattering particles in the center of the jet, whereas frozen particles are evenly distributed throughout the jet core. This is due to the previously explained fact that water droplets strike the nozzle walls and then stream down the walls, eventually exiting in the shear layer around the periphery of the jet. Solid ice particles, on the other hand, rebound from the wall into the main flow. From this consideration, it is easy to distinguish between an optimal case, where there should be no water in the shear layer, and a warm case, which will have clear evidence of the presence of water.

The concurrent abrasion tests further served to identify the optimum nitrogen flow rate. Since it was established that unfrozen water droplets do not have any significant abrasive effect, their presence in place of ice crystals in the blasting jet will reduce its efficacy. A qualitative impression was obtained by observing the removal rate of paint from a flat metal sample. There was an observed critical value of nitrogen flow rate of approximately 40:60 percent below which the abrasive ability of the jet was definitely reduced.

A combination of the three criteria developed above indicated that approximately equal mass flow rates of ambient-temperature air and liquid nitrogen were required for proper operation of the device. The resulting stagnation temperature was at or below 180 Kelvin. The mass flow rate of liquid nitrogen was approximately ¼ kg/min.

Another important parameter in the operation of the current ice blasting device is the ice/gas mass flow rate ratio or "mass loading." It is desirable to maximize this number, up to a certain limit, so that the maximum possible kinetic energy is extracted from the gas stream and imparted to the particles. This allows the particles to do more work on the material being removed, and achieves improved overall efficiency. Of course, the mass loading of the particles should not be so high as to render the device ineffective. In typical sandblasting operations, this ratio is as high as 1 (Seavey, M., "Abrasive blasting above 100 psi," *Journal of Protective Coatings and Linings*, Vol. 2, No. 7, July 1985, pp. 26–37).

Towards this end, higher flow rate pressure-swirl nozzles were obtained and tested. However, these tests were unsuccessful due to ice buildup problems similar to those experienced with the orifice-type atomizer. This was the case even for a nozzle with only twice the flow rate of the original nozzle.

Improved results can be obtained by using a larger diameter freezing chamber, which would increase the probability of water droplets being frozen prior to impact with the chamber walls. They will rebound from the walls and alleviate the problem of ice accumulation.

EXAMPLE V

Ice-Particle Characterization

The ice crystals produced by the current device were studied using optical techniques. The properties of primary interest were the particle size, some measure of the size distribution, particle velocity, trajectory, and hardness.

A measurement of 50 individual particle images was made and particle size was found to vary between approximately 45 and 100 μm, with an average size of approximately 70 μm. This average size is larger than the corresponding size of the water droplets thought to be produced by the atomizer, but direct measurements of water droplet size were not made, only an estimate was obtained based on empirical correlations found in the literature. The possibility of ice agglomeration also exists.

The average particle velocity obtained by streak velocity was 230 m/s. It should be noted that individual particles displayed very little variation around this value (plus or minus 5%, corresponding to 11 m/s). This observation indicates a narrow range of particle sizes.

Flow visualization at locations far downstream of the nozzle exit (as much as 20 exit diameters) revealed that the ice particles remained mostly confined to the core of the jet even when large-scale turbulence had caused the jet to spread significantly. Their trajectories remained essentially straight and parallel to the jet axis even when an obstruction (such as the work piece) was placed in the path of the blasting jet. This is a clear indication of the fact that these particles possess significant inertia and are unaffected by streamline curvature.

Particle hardness measurements were not carried out in the present experiments due to the difficulties involved in capturing and preserving these small ice particles. However, literature shows that ice has a hardness in the range of 2–4 on the Mohs scale (Ohmori, T., Kanno, I. and Fukumoto, T., "Method of cleaning a surface by blasting the fine frozen particles against the surface," U.S. Pat. No. 5,147,466, September 1992), with hard-frozen ice being at the higher end of this range. The data of Ohmori et al. show that the hardness of ice formed at temperatures below approximately 170 K is constant at 4 on the Mohs scale. At higher temperatures (170–250 K.) the hardness is generally lower. It is believed that the ice crystals obtained in the present experiments were on the lower end of the ice hardness range. (For comparison, a Mohs hardness of 4 is equivalent to that of copper.)

EXAMPLE VI

Abrasion Tests

The single most important desired characteristic of the device under development is its ability to perform coating removal tasks comparable to those performed by conventional equipment. Therefore it is important to quantify and document coating removal rates, type of coating, substrate thickness, etc. An in-house test of measuring these values was devised.

Three different types of sample were used: discarded machinery/automobile parts for grease removal tests, metal parts newly painted with enamel-based paint, and metal parts newly painted with epoxy-based paint. The first were obtained from a local automobile repair facility whereas the others were prepared in the laboratory. Flat panels of polished aluminum were sanded (with #220 grit aluminum oxide abrasive cloth) to improve paint adhesion, spray painted with 4–5 coats of either enamel or epoxy paint, and allowed to cure for approximately 48 hours. The thickness of the resulting coating was measured, and the actual tests were videotaped to allow the determination of removal rates. The sample was held approximately 10–15 cm (4–6 inches) from the nozzle exit at a 30–45 degree angle to the jet axis. These parameters had been earlier determined to provide optimal removal rates.

It was difficult to quantify the grease removal tests due to several factors. These included uneven thickness of the coatings, a combination of different coatings (rust, scale, grease, etc.) being present, and the generally complex geometry of the parts. Therefore, these tests are only qualitatively described. The present equipment was successful in removing grease from these parts quite rapidly. After completion of the tests, the parts were dry and no longer greasy to the touch.

The thickness of the paint coatings was 0.03 mm (1.2 mils) for the enamel paint, and 0.05 mm (2 mils) for the epoxy paint. Paint removal rates achieved for the enamel paint were in the range 0.01 0.02 $m^2$/min. This value is about five to ten times lower than other ice-blasting equipment, and ten to a hundred times lower than grit blasting equipment (Seavey, M., "Abrasive blasting above 100 psi," *Journal of Protective Coatings and Linings*, Vol. 2, No. 7, July 1985, pp. 26–37). Improved results may be obtained by increasing the mass loading of the device (i.e., by increasing the water flow rate to the atomizer while maintaining other parameters constant).

The blasting jet was also directed against a bare, polished aluminum surface to gage its effect on substrate finish. There was no observable damage, illustrating the relatively benign nature of ice blasting. It has already been mentioned that this may actually be desirable in certain applications.

From the above it should be clear that the present invention produces ice crystals on demand and accelerates them through a blast nozzle. This device can be used to abrasively clean substrate surfaces with minimal damage to the target surface, since these ice crystals are much smaller than the pelletized material typically used in ice and dry-ice blasting.

We claim:

1. An abrasive cleaning device, comprising:

a) a mixing chamber having a length, diameter and first and second ends;

b) a cryogenic fluid inlet connected to said first end of said mixing chamber;

c) an air inlet connected to said first end of said mixing chamber;

d) a water atomizer connected to said second end of said mixing chamber;

e) a freezing chamber in fluidic communication with said mixing chamber; and f) a blast nozzle in fluidic communication with said freezing chamber.

2. The device of claim 1, wherein said blast nozzle is a supersonic blast nozzle.

3. The device of claim 1, wherein said mixing chamber contains a flow spreader.

4. The device of claim 1, wherein said water atomizer is a pressure-swirl atomizer.

5. The device of claim 1, further comprising a transition coupling between said freezing chamber and said blast nozzle.

6. The device of claim 1, wherein said length of said mixing chamber is approximately fifty centimeters long and said diameter of said mixing chamber is approximately five centimeters in diameter.

7. The device of claim 1, further comprising a T-coupling between said mixing chamber and said freezing chamber.

8. The device of claim 1, wherein said blast nozzle is a converging-diverging nozzle.

* * * * *

UNITED STATES PATENT AND TRADEMARK OFFICE

CERTIFICATE OF CORRECTION

PATENT NO. : 5,785,581
APPLICATION NO. : 08/734444
DATED : July 28, 1998
INVENTOR(S) : Gary S. Settles It is certified that error appears in the above-identified patent and that said Letters Patent is hereby corrected as shown below:

Column 1, Line 8, after the priority claim, and before "FIELD OF THE INVENTION" insert the following:

--GOVERNMENT SPONSORSHIP

This invention was made with Government support under Grant No. CTS 9305311, awarded by The National Science Foundation. The Government has certain rights in the invention.--

Signed and Sealed this

Twenty-third Day of December, 2008

JON W. DUDAS
*Director of the United States Patent and Trademark Office*